US007526937B2

(12) United States Patent
Zauhar

(10) Patent No.: US 7,526,937 B2
(45) Date of Patent: May 5, 2009

(54) CAN BOTTOM FORMING ASSEMBLY

(76) Inventor: Mark L. Zauhar, 18756 Knollwood Cir., Lakeville, MN (US) 55044

( * ) Notice: Subject to any disclaimer, the term of this patent is extended or adjusted under 35 U.S.C. 154(b) by 0 days.

(21) Appl. No.: 11/904,861

(22) Filed: Sep. 28, 2007

(65) Prior Publication Data

US 2008/0028818 A1 Feb. 7, 2008

Related U.S. Application Data

(63) Continuation-in-part of application No. 11/346,132, filed on Feb. 2, 2006, now Pat. No. 7,290,428.

(51) Int. Cl.
*B21D 22/00* (2006.01)

(52) U.S. Cl. ..... 72/347; 72/466.7; 413/69

(58) Field of Classification Search ..... 72/347, 72/348, 354.8, 466, 466.7, 482.91; 413/56, 413/62, 69

See application file for complete search history.

(56) References Cited

U.S. PATENT DOCUMENTS 2,038,466 A 4/1936 Yates
3,835,666 A * 9/1974 Hoffman ..... 464/139
4,257,254 A * 3/1981 Adamus et al. ..... 72/432
4,324,124 A 4/1982 Maeder
4,930,330 A * 6/1990 Weishalla ..... 72/348
5,797,292 A * 8/1998 Johansson et al. ..... 72/348
6,070,447 A * 6/2000 Bone et al. ..... 72/348
6,351,981 B1 3/2002 Jowitt et al.
6,490,904 B1 * 12/2002 Zauhar ..... 72/348
6,616,393 B1 * 9/2003 Jentzsch ..... 413/67

* cited by examiner

*Primary Examiner*—Dana Ross
*Assistant Examiner*—Debra M Sullivan
(74) *Attorney, Agent, or Firm*—Anthony G. Eggink; Katrina M. Eggink

(57) ABSTRACT

A can bottom forming assembly for use in forming the bottom of metal cans, such as steel and aluminum two piece cans. The bottom forming assembly is lightweight, compact and comprises outer and cylinder housing assemblies which house a clamp ring retainer assembly, a transfer piston assembly and an annular spring member. The clamp ring retainer assembly includes biasing members to float a clamp ring thereby centering the clamp ring and domer die plug with respect to the ram of a bodymaker. Increased piston size, spring position and size are provided to permit increased clamp ring pressure.

20 Claims, 11 Drawing Sheets

CAN BOTTOM FORMING ASSEMBLY

This invention is a continuation-in-part of U.S. patent application Ser. No. 11/346,132, filed on Feb. 2, 2006 now U.S. Pat. No. 7,290,428.

BACKGROUND OF THE INVENTION

The present invention relates generally to assemblies used in the manufacture of metal containers. Particularly, the invention relates to a bottom forming assembly used in the drawing and forming of the bottom portions of two piece steel and aluminum cans.

The can bottom forming assembly of the present invention is an improvement of the bottom formers disclosed in U.S. Pat. No. 4,930,330 ('330 patent) to Weishalla, entitled Double Action Bottom Former, and U.S. Pat. No. 6,490,904 B1 ('904 patent) to Zauhar, entitled Double Action Bottom Former for High Cyclic Operation, both owned by the Assignee of the present invention. The bottom formers of the '330 and '904 patents, incorporated by reference herein, are constructed and arranged for cooperating use with a can bodymaker and specifically, the bodymaker punch carrying the can bodies. The '330 patent and the '904 patent disclose dome plug positioning structures for bottom forming assemblies. The present invention provides further improvements for can bottom forming assemblies.

The '330 and '904 patents disclose can bottom forming processes including the action of the punch or ram of a can bodymaker assembly with respect to a bottom forming assembly. Bottom forming assemblies are typically constructed and arranged to cooperate with bodymaker assemblies. The bottom former receives can bodies on the rapid cycling bodymaker punch and forms two piece can body bottoms through a drawing and final forming process utilizing a clamp ring and dome plug. The term clamp ring is also known in the industry as a pressure ring, guide ring or outer die. The term dome plug is also known in the industry as an inner die or dome post. The specific manufacture of cans, beverage or food, may determine the use of the particular term. Spatial control of the clamp or guide ring along and normal to the axis of ram movement is imperative for manufacturing quality, production and efficiency. The thicknesses of can body bottoms are becoming increasingly thinner requiring specified can bottom profiles to provide strength and which make manufacturing control imperative. Thus, increased clamp ring pressure and a more compact can bottom forming assembly aids in maintaining can bottom profile and thickness tolerances.

The bottom forming assemblies of the present invention provide a compact, lightweight, easy to maintain and service bottom forming assembly having a novel arrangement of components to provide the requisite clamp ring pressure and improving the centering and biasing control of the clamp ring.

SUMMARY OF THE INVENTION

The present invention provides a bottom forming assembly which is an easy to service doming assembly which floats a clamp ring to respond to variations in bodymaker punch locations. The bottom forming assembly of the invention includes a configuration which provides increased piston size, increased clamp ring pressure, a lightweight construction and an improved biasing means to float the clamp ring.

In making a two piece can body, the walls of the can body are formed in a bodymaker assembly, the operation of which is described in the '330 and '904 patents which are incorporated by reference herein. Typically, a punch, i.e. from the bodymaker structure, carries the can body out of the tool pack to the clamp ring of the bottom forming assembly. In the improved bottom forming assemblies of the present invention, the clamp ring is constructed and arranged to float to thereby guide the punch to the center of the doming assembly and to re-center upon the exit of the punch. As the punch travels into the bottom forming assembly, the clamp ring structure axially centers the punch with the dome plug. When making two piece beverage cans, the clamp ring is used as a draw ring to apply pressure on the can material as it flows into the dome, thus controlling the material flow and preventing wrinkles. When making two piece food cans, the clamp ring acts as a guide member to align grooves in the punch with mating grooves in the inner die or dome plug. With thinner materials being used to make cans, a strong can bottom profile is desired. In order to make such a bottom profile, a clamp ring must be able to apply a specified pressure on the can material.

An embodiment of the bottom forming assembly of the present invention is comprised of a clamp ring assembly, a dome plug, an annular spring member, an outer housing assembly, a piston assembly and a cylinder housing assembly. A cover chamber is located at the end of the bottom forming assembly which defines a pressure build-up and release chamber. The assembly is preferably mounted to a bodymaker using a mounting flange, at least one spacer member, the outer and cylinder housings and tension bolts. The assembly is constructed and arranged to have an increased piston diameter and larger spring surface compared to prior art assemblies and provides a compact, lightweight structure. The clamp ring is floated using a plurality of hardened pins which are under air pressure force.

It is an advantage of the present invention to float the clamp ring to thereby improve production and product quality, i.e., by reducing the chance of can deformities, for example split or cracked domes caused by off-center hits. It is an advantage of the present invention to provide an improved bottom forming assembly which is constructed and arranged having a center of gravity which is located closer to the tool pack assembly, of a bottom forming assembly, for example. It is a further advantage of the present invention to provide a compact bottom forming assembly which provides increased piston size, increased annular spring surface, increased clamp ring pressure and improved performance.

These and other benefits and advantages of this invention will become clear from the following description by reference to the drawings.

DESCRIPTION OF THE PREFERRED EMBODIMENTS

The can bottom forming assembly of the present invention provides a compact, lightweight bottom forming assembly which provides a floated clamp ring to center the ram or punch of a bodymaker and which has a center of gravity relatively closer to the tool pack. By increasing the piston size and spring diameter, a greater clamp ring pressure is attained. This arrangement of components also provides a light, compact bodymaker structure having a center of gravity closer to the tool pack and punch interface.

Figure 1:
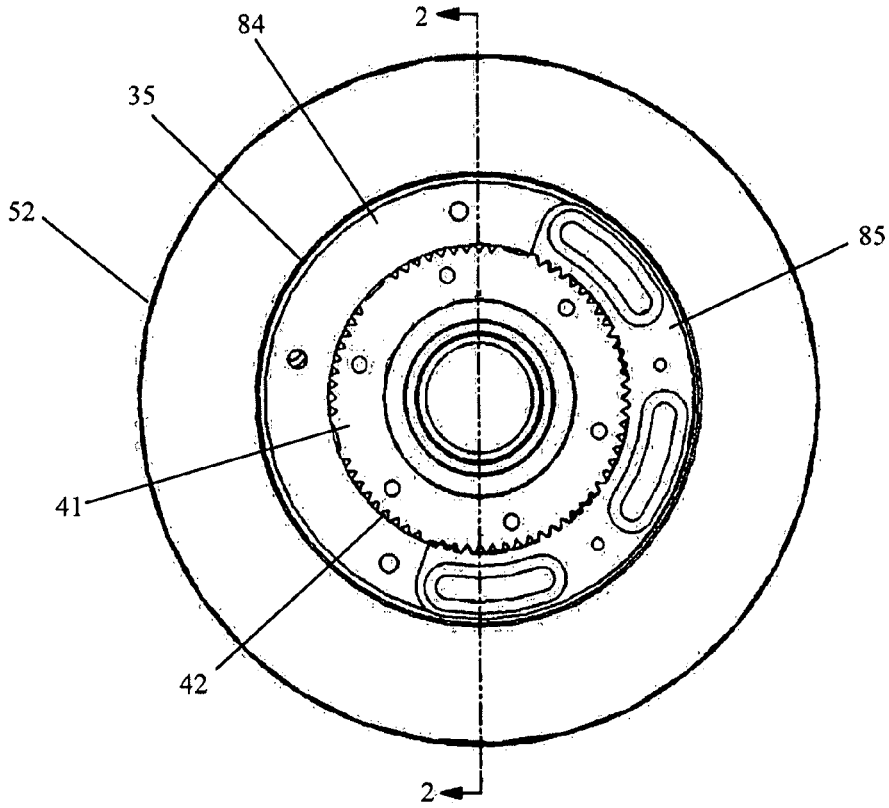
FIG. 1 is a front plan view of the can bottom forming assembly of the present invention.
Figure 2:
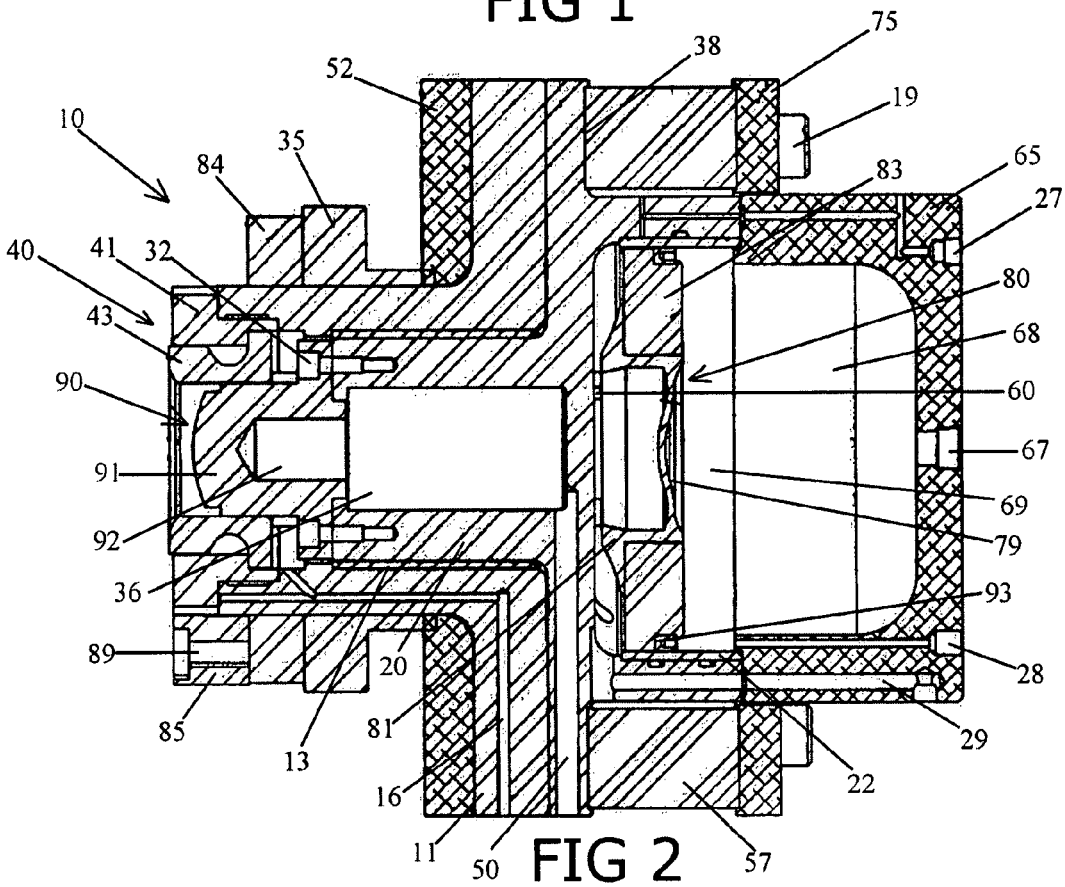
FIG. 2 is a sectional view of the bottom forming assembly of FIG. 1 taken along line 2-2.
Figure 3:
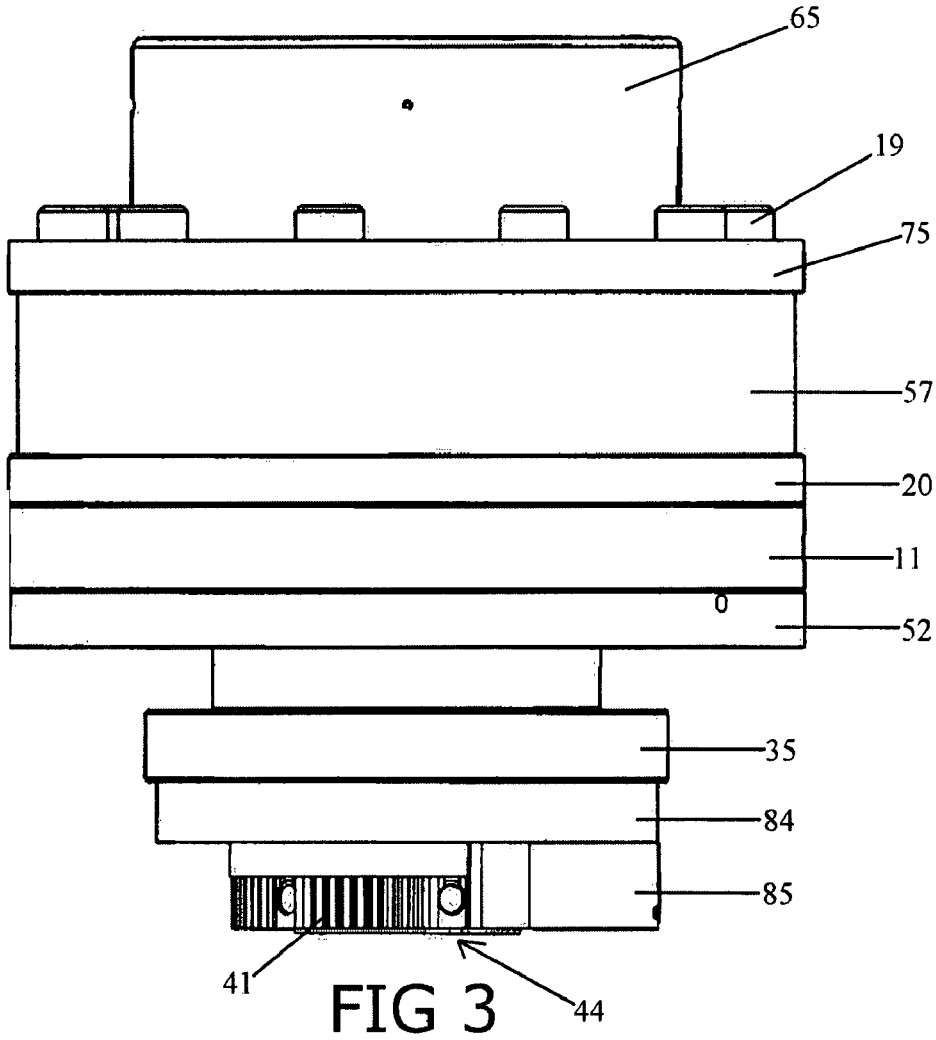
FIG. 3 is a top plan view of the bottom forming assembly of FIG. 1.

Referring to FIGS. 1-3, bottom forming assembly 10 is shown having outer housing assembly 11 and cylinder housing assembly 20. Clamp ring retainer assembly 40 having biasing means 44 shown at the front of the bottom forming assembly and holding floating clamp ring 43. Clamp ring retainer assembly 40 is shown held in place by locking device 85. The clamp ring retainer assembly 40 is shown positioned adjacent dome plug assembly 90 and abutting outer housing assembly 11. Outer housing assembly 11 is shown having bushing 13 which cooperates with cylinder housing assembly 20. Cylinder housing assembly is shown joined to dome plug assembly 90 via fastener 32. Push rods 60 are shown and which extend from clamp ring 43 and through cylinder housing assembly 20. Each push rod 60 is shown terminating at piston assembly 80 which slidably moves within chamber 69 via bushing 22. Dome plug assembly 90 is shown having body 91 and defining vent cavity 92. Cavity 92 is shown in communication with cavity 36 and drain channel 50 of cylinder housing assembly 20.

Figure 24:
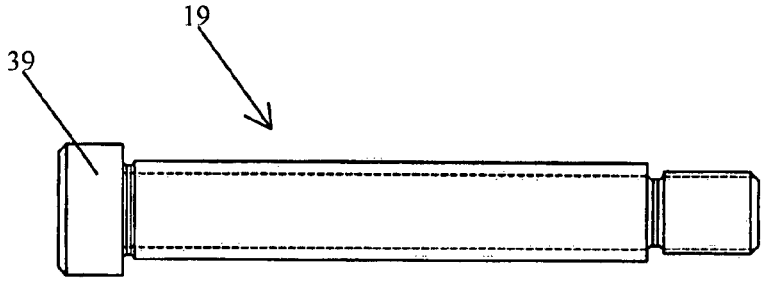
FIG. 24 is a side plan view of the tension bolt member of FIG. 23.

Cover chamber 65 is shown forming chamber 68 and is shown attached to the end of the bottom forming assembly 10, namely to cylinder housing 20. Cover chamber 65 is shown having oil inlet aperture 27, coolant inlet 28, and drain 29. The bottom forming assembly of this invention is constructed and arranged to be mounted to a bodymaker door using mounting flange 35, spacer 52 and a plurality, i.e. ten, tension bolts 19 having hex-heads 39, as shown in FIG. 24. Tensions bolts 19 extend through apertures in spring end plate 75, spring 57, cylinder housing 20, outer housing 11, spacer 52, the bodymaker door (not shown) and are secured on the other side of the bodymaker door structure.

Figure 4:
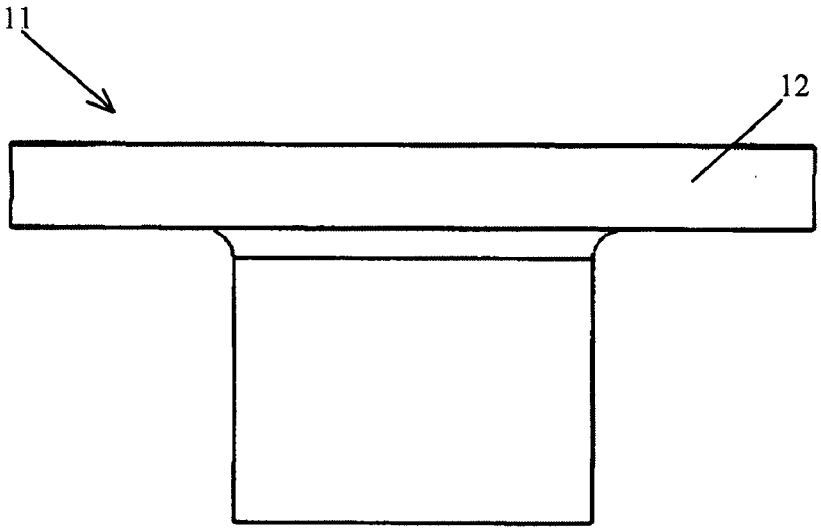
FIG. 4 is a top plan view of the of the outer housing assembly of the invention.
Figure 5:
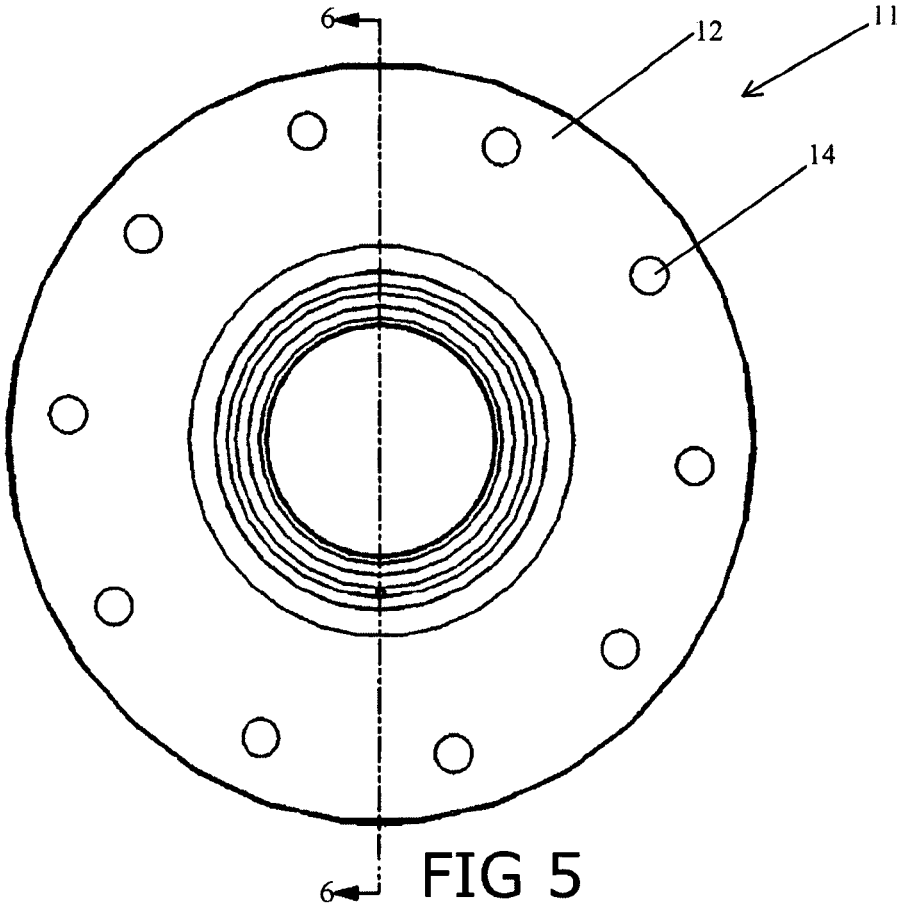
FIG. 5 is a front plan view of the outer housing assembly of FIG. 4.
Figure 6:
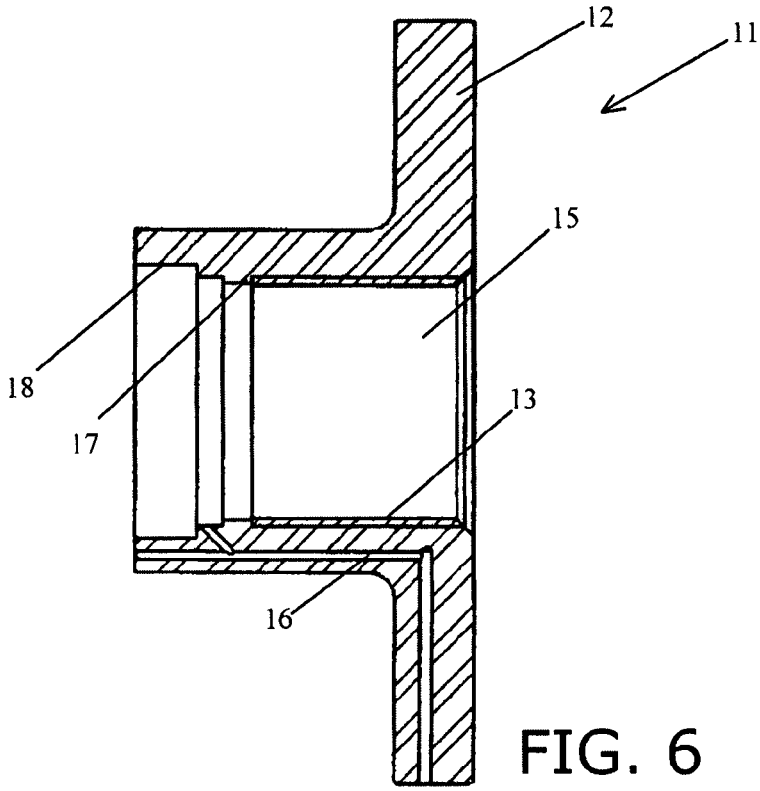
FIG. 6 is a sectional view of the outer housing assembly of FIG. 5 taken along line 6-6.
Figure 7:
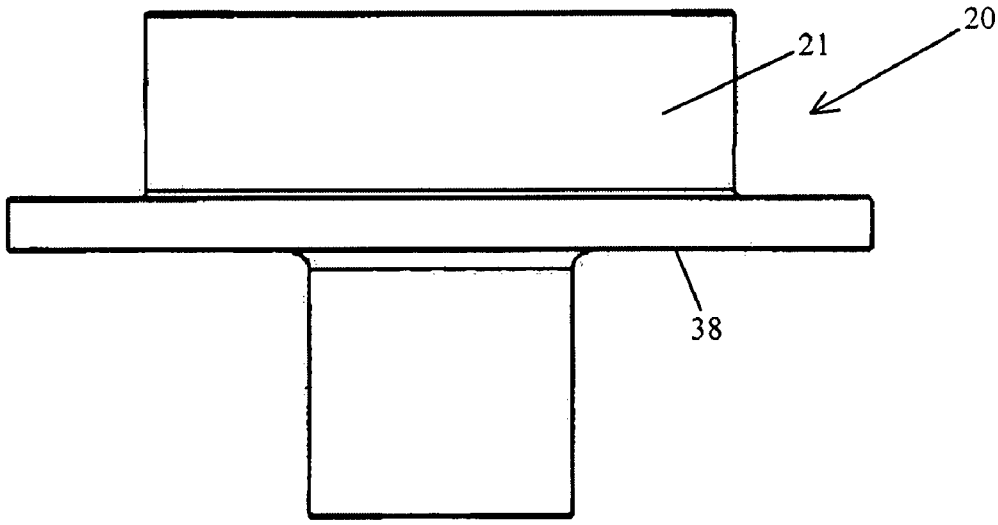
FIG. 7 is a top plan view of the cylinder housing assembly of the assembly of FIG. 1.

FIGS. 4-6 show outer housing assembly 11 having a generally cylindrical body 12 and forming cavity 15 which houses bushing 13. Cavity 15 and cooperating bushing 13 are constructed and arranged to house and cooperate with portion 33 of cylinder housing assembly 20, as shown in FIG. 2 and further shown and discussed with respect to FIGS. 9 and 10. Annular abutment ledges 17 and 18 are shown and which are axially aligned and constructed and arranged to cooperate with elements of the clamp ring retainer assembly. Specifically, plug body 91 abuts ledge 17 and clamp ring retainer body abuts ledge 18, which has a larger diameter than annular ledge 17. Apertures 14 are shown and are constructed and arranged to receive tension bolts 19 (shown in FIG. 2). Drain 16 is further shown and is provided to remove excess coolant. Bushing 13 is preferably constructed of a polymeric composite material, such as those manufactured by HyComp, Inc., or similar polymeric, greaseless, self-lubricating materials. Outer housing assembly 11 is preferably constructed of tool steel or a like hard material.

In use, the punch of the bodymaker which carries the can body to the bottom former assembly 10 strikes the can body against the clamp ring assembly and transfers force on the piston assembly and spring member. The die plug 90 is attached to the cylinder housing 20, which causes spring 57 to be compressed. It is desirable to provide an annular spring structure having a large diameter to provide an increased force absorbing area to absorb the requisite clamp ring pressure to form the desired can bottom profile. The piston assembly 70 moves within the cylinder housing 20 and compresses the spring member 57. It is desirable to measure this movement, for example using an overtravel measuring device (shown as element 94 in FIG. 4 of the Ser. No. 11/346,132 application, which is fully incorporated by reference herein) contained in outer housing assembly 11, to measure the travel movement within the bottom forming assembly and to make adjustments or replacements if necessary, for example changing the spring member or adjusting the bottom former position if excessive overtravel is detected.

Figure 8:
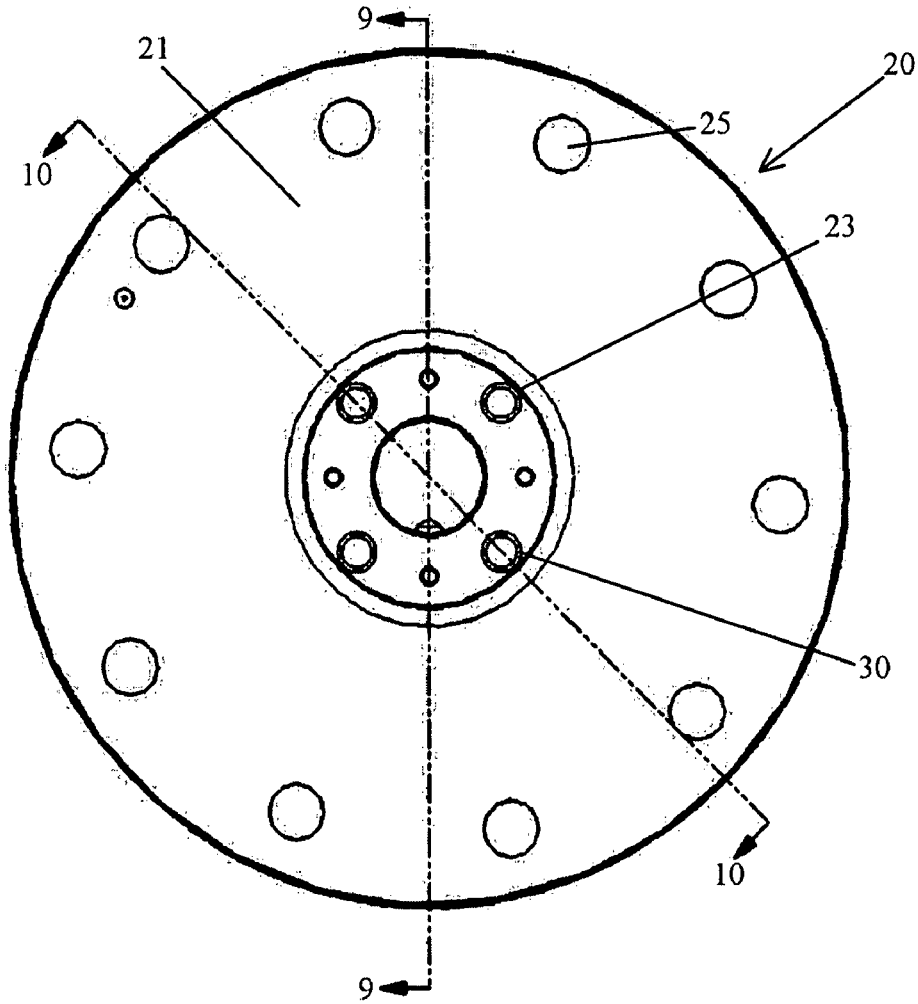
FIG. 8 is a front view of the cylinder housing assembly of FIG. 7.
Figure 9:
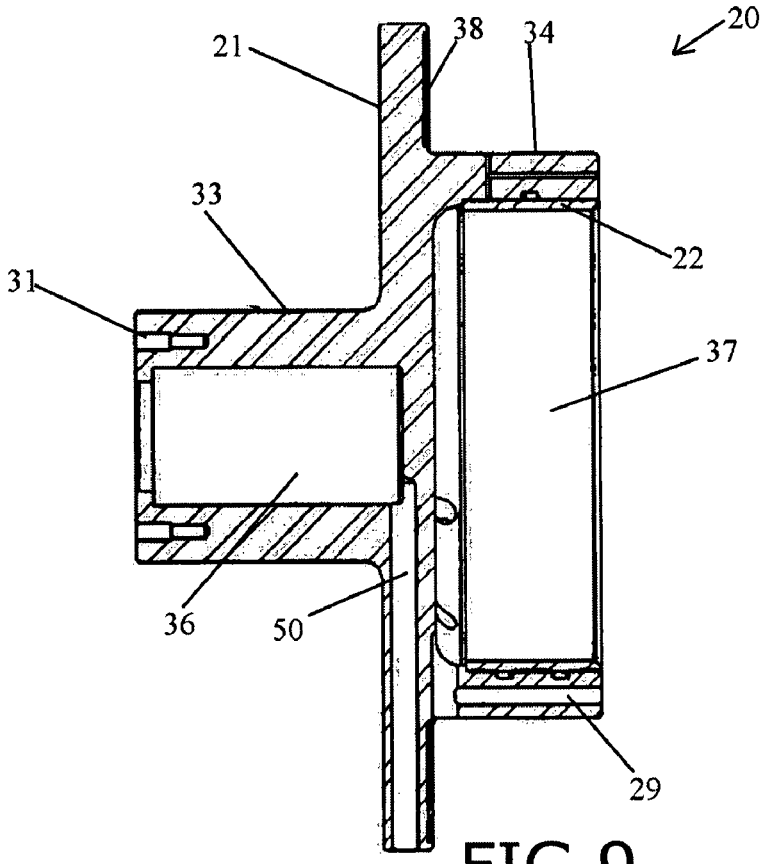
FIG. 9 is a sectional view of the cylinder housing assembly of FIG. 7 taken along line 9-9.
Figure 10:
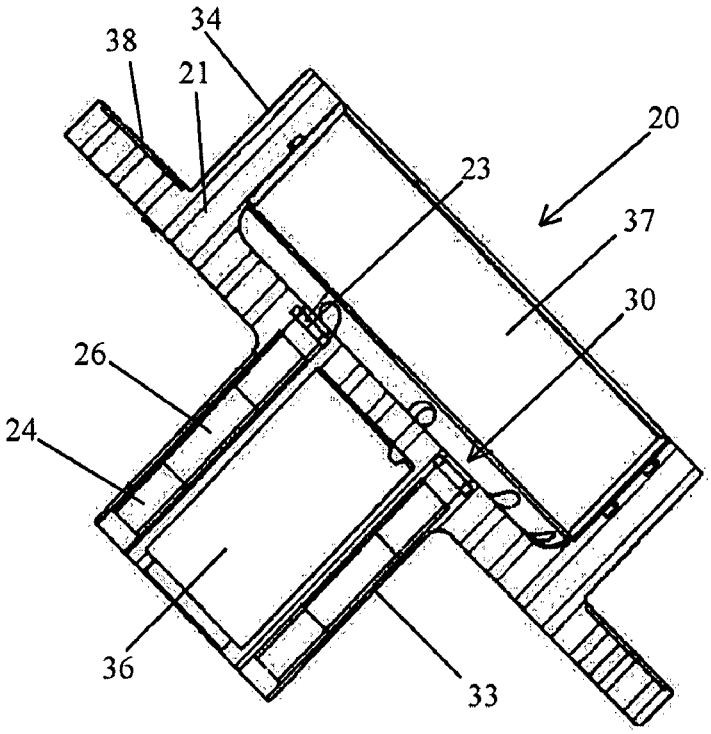
FIG. 10 is a sectional view of the cylinder housing assembly of FIG. 7 taken along line 10-10.

FIGS. 7-10 show cylinder housing 20 having body 21 which has a generally circular cross-section, as shown in FIG. 8. As shown in FIG. 8, apertures 25 for receiving tension bolts are shown located radially around cylinder housing body 21. As shown in FIGS. 9 and 10, cylinder housing body 21 has two opposing, outwardly extending cylindrical ends, 33 and 34, each forming a cavity 36 and 37, respectively. Bushing 22 is shown located within cavity 37 and thereby cooperating with cylinder housing body 21. Bushing 22 is preferably made of a ceramic or like low friction material. As shown in FIG. 2, bushing 22 provides a low friction surface for slidably engaging piston seal 93 and annular piston ring 83. Aperture 31 is shown in FIG. 9 located in body 21 and is utilized for the securement of the cylinder housing body 21 to the domer die plug body 91. Specifically, aperture 31 is constructed and arranged to receive fastener 32 shown in FIG. 2. Push rods are constructed and arranged to fit through the cylindrical wall of cylindrical end 33 through apertures 30, shown in FIGS. 8 and 10.

Cylinder housing body 21 is shown having opposing axially aligned cylinders 33 and 34 separated by a circular wall having an annular peripheral ledge 38 which extends outward from cylinders 33 and 34. First cylindrical end 33 has a diameter D1 and second cylindrical end 34 has a diameter D2, which is larger than D1. Plug body 91 of domer die plug 90 is axially mounted to the first cylindrical end 33 of cylinder housing assembly 20 and which reciprocates within bushing 13. Outer plate or wall of cylindrical housing 20 has a peripheral ledge 38, defined by second cylindrical end 34 having a diameter $D_3$ and on which annular spring member 57 is positioned. Cover member 65 is mounted to second cylindrical end 34, having diameter $D_2$. Piston assembly 80 reciprocates within ceramic bushing 22 in cavity 37 of second cylindrical end 34 of cylindrical housing 20.

Figure 21:
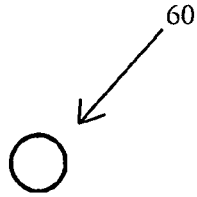
FIG. 21 is a top plan view of the push rod member of the assembly of FIG. 1.
Figure 22:
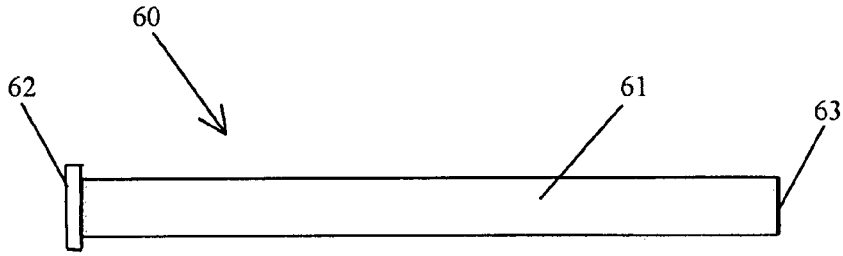
FIG. 22 is a front plan view of the push rod member of FIG. 21.

Cylinder housing body 21 is further shown in FIGS. 8 and 10 to have push rod seals 23, apertures 30 to receive a push rod 60, and bushing 24 and sleeve 26 within apertures 30. Push rods 60, shown in FIGS. 2, 21 and 22 are constructed and arranged to be slidably engaged with the cylinder housing body 21 through apertures 30. Further, drain or channel 50 is shown located in body 21 to aid the passage of air for pressure release resulting from the striking of the dome plug. As shown in FIG. 2, cavity 92 of dome plug assembly 90, cavity 36 and drain 50 of cylinder housing assembly 20 are shown in communication with each other and thus forming a pressure release channel through the bottom forming assembly 10. Cylinder housing assembly 20 is preferably constructed of tool steel to provide a bottom former assembly with a center of gravity closer to the mounting apparatus on the bodymaker.

Figure 11:
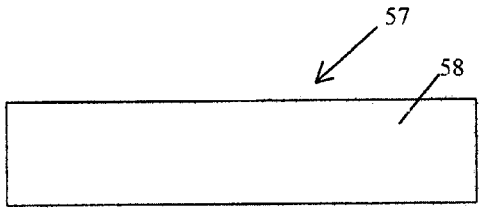
FIG. 11 is a top plan view of the spring member of the assembly of FIG. 1.
Figure 12:
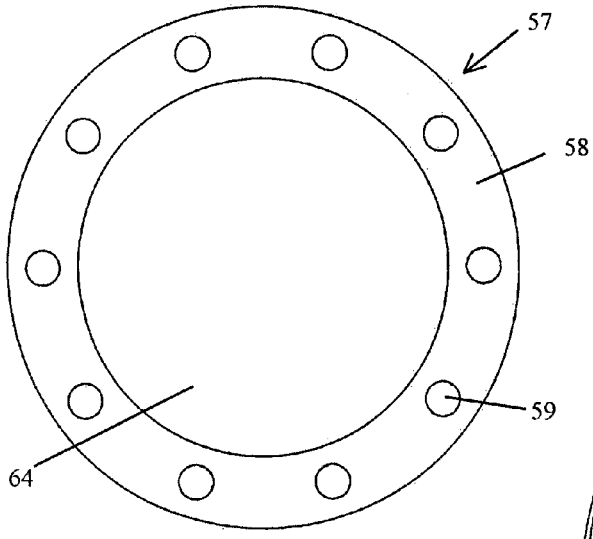
FIG. 12 is a front plan view of the spring member of FIG. 11.
Figure 23:
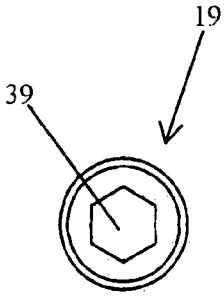
FIG. 23 is a front plan view of the tension bolt member of the assembly of FIG. 1.

FIGS. 11 and 12 show spring member 57 having body 58 having radial apertures 59 and central aperture 64. Aperture 64 is shown centrally disposed in spring member body 58 and is constructed to fit around portion 34 of cylinder housing assembly 20. Spring member 57 is constructed to be positioned between ledge 38 of cylinder housing 20 and spring end plate 75. Spring member 57 is preferably constructed of urethane or a like compressible material. Apertures 59 are constructed and arranged to receive tension bolts 19 extending therethrough, which are shown in FIGS. 23-24 having hex heads 39. It has been found that large piston size and spring diameter are optimal for absorbing forces in the bottom former environment when increasing clamp ring pressure. Increasing the spring diameter and positioning the spring around the cylinder housing (within which the piston reciprocates) also provides an assembly having a compact structure.

Figure 13:
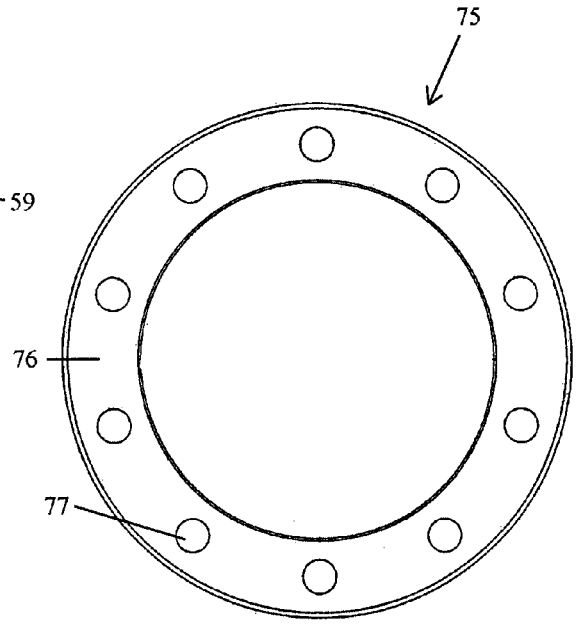
FIG. 13 is a front plan view of the spring end plate member of the assembly of FIG. 1.
Figure 14:
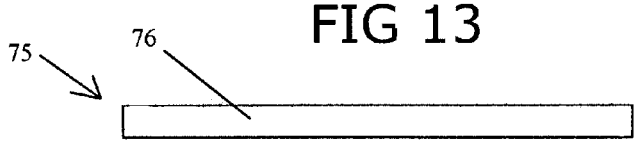
FIG. 14 is a top plan view of the spring end plate member of FIG. 13.

FIGS. 13 and 14 show spring end plate 75, having a generally circular body 76 and apertures 77 for receiving tension bolts 19 therethrough. Spring 57 is shown in FIG. 2, disposed between cylinder housing 20 and spring end plate 75. Tension bolts 19 are shown extending through spring end plate 75, spring 57 and cylinder housing 20 and fastening to outer housing 11.

As shown in FIG. 2, spring member 57 has an annular configuration and is disposed around cylindrical end 34, between wall 38 of cylinder housing 20 and spring end plate 75. As also shown in FIG. 2, cylindrical end 33 of cylinder housing 20 slidably moves within bushing 13 when force is exerted upon dome plug assembly 90. Thus, spring member 57 is compressed, thereby, absorbing force. Clamp ring 43 is constructed and arranged to abut push rods 60. Push rods terminate at piston assembly 80. Piston assembly 80 is shown in FIG. 2 comprised of annular piston wall 81, annular piston ring 83 and piston end member 79. When force is exerted on clamp ring 43 and dome plug 90, push rods 60 transfer force on piston assembly 80, which moves within bushing 22 and chamber 69 of cylindrical end 34. Cylindrical end 33 of cylinder housing 20 moves within outer housing 11 via bushing 13, thereby moving cylinder body 21 having peripheral wall 38 and compressing spring member 57 against spring end plate 75. Bushing 22 is preferably made of a ceramic or like low friction material, and bushing 13 is preferably made of a polymeric composite material or like low friction material.

Mounting flange 35 is shown in FIG. 2 and is further shown in FIGS. 10 and 11 of the Ser. No. 11/346,132 application, which is fully incorporated by reference herein. Tension bolts 19 and mounting flange 35 are utilized to mount the bottom forming assembly 10 to a bodymaker. The mounting flange 35 is preferably constructed of tool steel or a like material.

Figure 15:
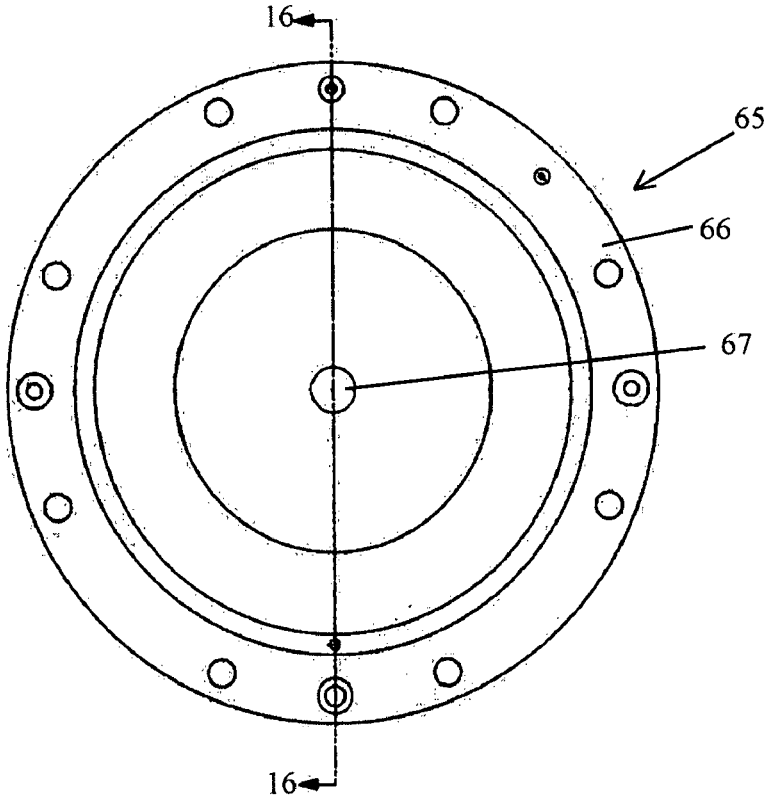
FIG. 15 is a front plan view of the cover chamber assembly of the assembly of FIG. 1.
Figure 16:
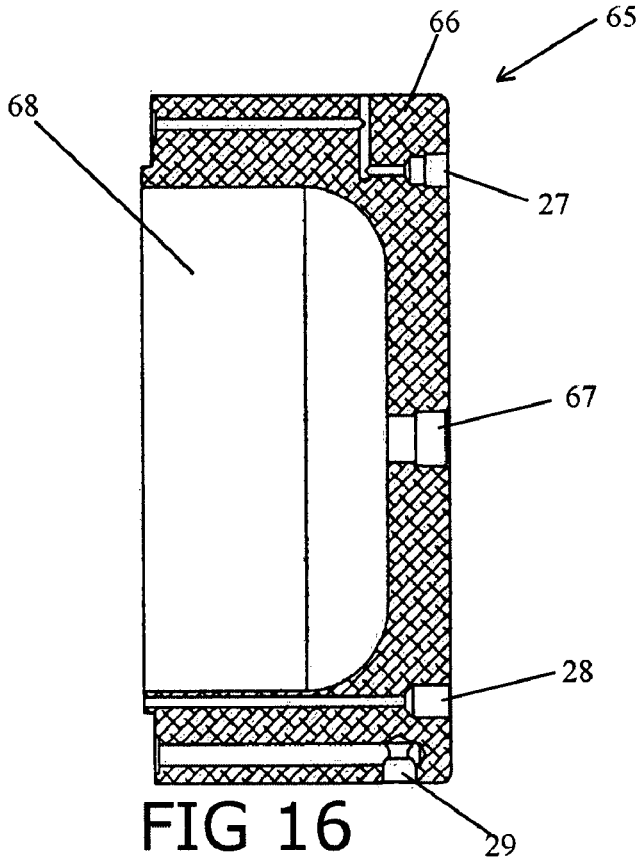
FIG. 16 is a sectional view of the cover chamber assembly of FIG. 15 taken along line 16-16.
Figure 17:
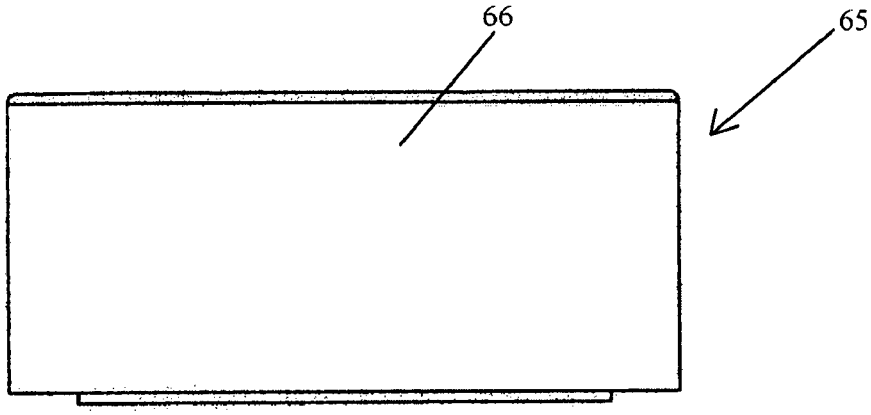
FIG. 17 is a top plan view of the cover chamber assembly of FIG. 15.

Referring to FIGS. 15-17, oil inlet aperture 27, coolant inlet 28 and drain 29 are shown disposed in cylinder housing body 21. FIGS. 8 and 9 are sectional views of the cylinder housing assembly 20, showing body 21 drains 29 and 50 being disposed in body 21. Cylinder housing body 21 is shown generally cylindrical in shape and is preferably made of tool steel.

FIGS. 15-17 show cover chamber assembly 65 having body 66. Body 66 is shown having cleaning port 29 and pressurized air line aperture 67. As shown in FIG. 2, cover chamber 65 is shown disposed at the end of bottom forming assembly 10 and defining chamber 68. In operation, the air inside the bottom former is compressed due to the punch of the ram and the stroke of the piston assembly within the bottom former. Chamber 68 and pressurized air line aperture 67 provides release for this built-up pressure. Cleaning port 29 can be opened to clean or blow out excess coolant and air. Cover chamber assembly 65 is preferably constructed of aluminum or like lightweight material to reduce mass and to effect the center of gravity of the bottom former.

Figure 18:
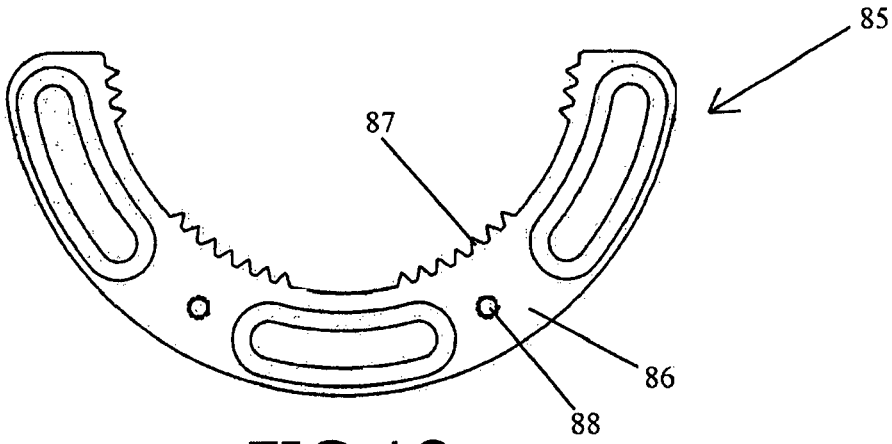
FIG. 18 is a front plan view of the locking device of the assembly of FIG. 1.
Figure 19:
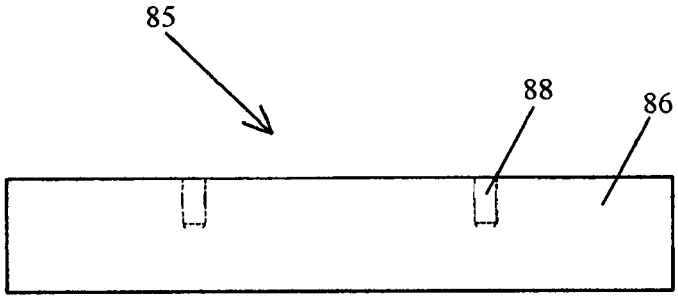
FIG. 19 is a bottom plan view of the locking device of FIG. 18.
Figure 20:
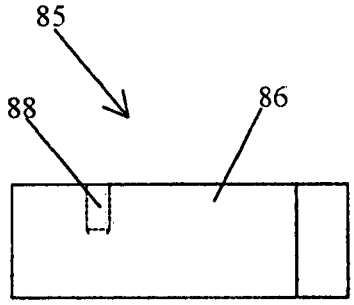
FIG. 20 is a side plan view of the locking device of FIG. 18.

FIGS. 18-20 show locking device 85 having body 86 and teeth 87. Apertures 88 are shown and are for securement of the locking device 85 to the locking nut 84 shown in FIG. 2. As discussed above, teeth 87 of locking device body 86 cooperate with teeth 42 of clamp ring retainer body 41 to secure the clamp ring retainer assembly in place.

As shown in FIGS. 21-22, push rods 60 have an elongated cylindrical body 61 with opposing and different ends 62 and 63. Specifically, a capped end 62 is provided to permit the push rods to be placed within the bottom former assembly 10 in the proper manner and to prevent push rod seal damage.

Figure 25:
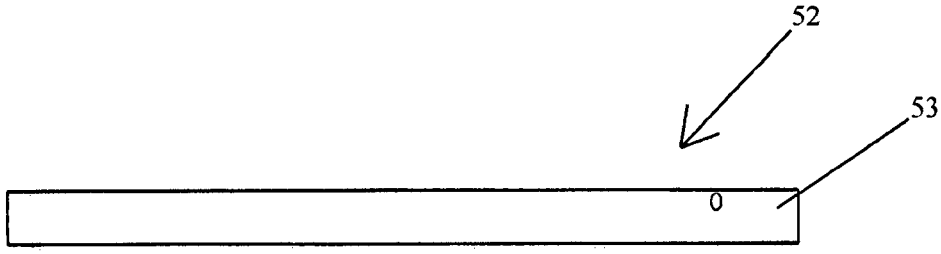
FIG. 25 is a top plan view of the solid spacer member the assembly of FIG. 1.
Figure 26:
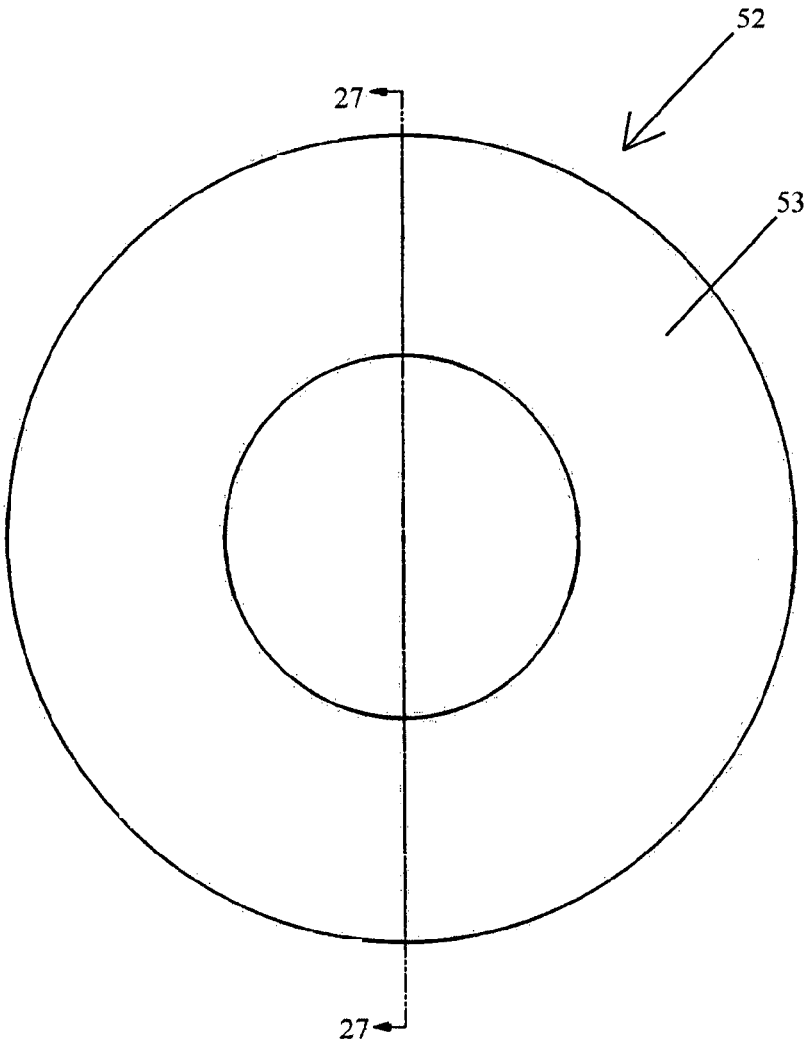
FIG. 26 is a from plan view of the solid spacer member FIG. 25.
Figure 27:
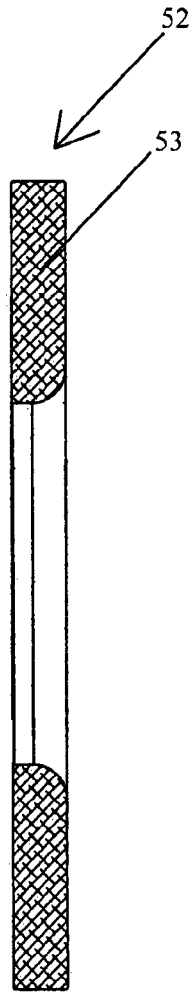
FIG. 27 is a sectional view of the solid spacer member of FIG. 26 taken along line 27-27.

FIGS. 25-27 show spacer member 52 having annular body 53. Spacer member 52 is preferably constructed of aluminum or a like material and is designed to be ground to provide a proper fit to the particular bodymaking machine to which the bottom forming assembly is mounted. Spacer member 52 preferably has a hard coating for protection as spacer member contacts outer housing assembly during use. Because the outer housing assembly is preferably made of tool steel and the spacer member is preferably made of aluminum, the spacer member is preferably coated for toughness to prevent wear due to contact with tool steel or a like hard material. The spacer member 52 structure is constructed of a lightweight material to further decrease mass and to change the center of gravity of the bottom former.

FIGS. 28-31 show clamp ring retainer assembly 40 having body 41 with peripheral cavities 51 to hold biasing means 44 which float the clamp ring in the bottom forming assembly 10. Clamp ring 43 is shown in use with clamp ring retainer assembly 40 in FIG. 2. Teeth 42 are shown peripherally disposed on body 41 and are constructed and arranged to communicate with teeth 87 of locking device 85 (shown in FIG. 18) to secure and position the clamp ring retainer device. Biasing means 44 are shown comprising cooperating elements, namely, ball member 45, first cap member 46, spring member 47, second cap member 48 and clip member 49, which fit into cavities 51. Preferably, spring member 47 is constructed of urethane or a like compressible material. Ball member 45 is preferably constructed of nitrate or a similar material. Further, it is within the purview of this invention to utilize an alternate spring or biasing means, for example a coil or other mechanical spring structure or other biasing means known in the art. It is further within the purview of this invention to utilize a pin shaped member or a ball shaped member in cooperation with the biasing means.

Figure 28:
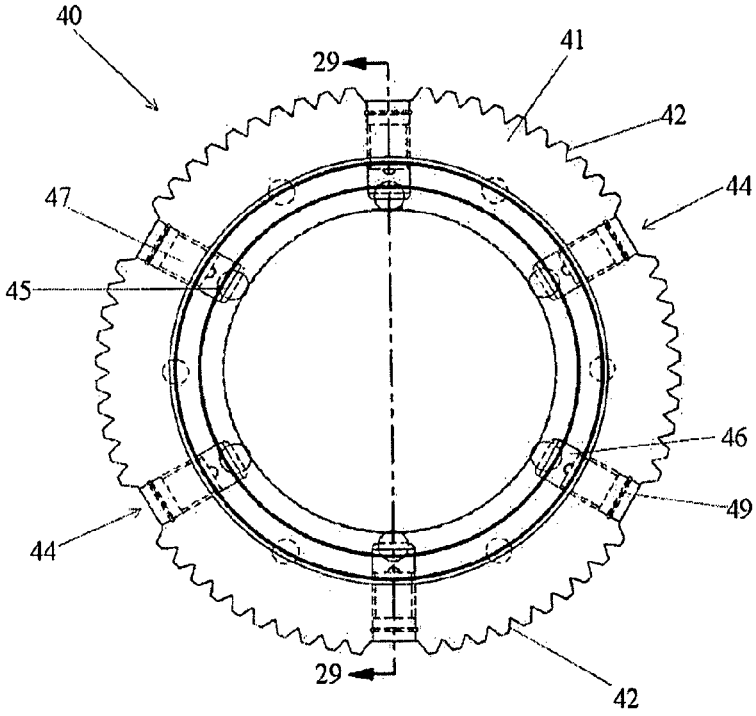
FIG. 28 is a front plan view of the clamp ring retainer assembly of the assembly of the invention.
Figure 29:
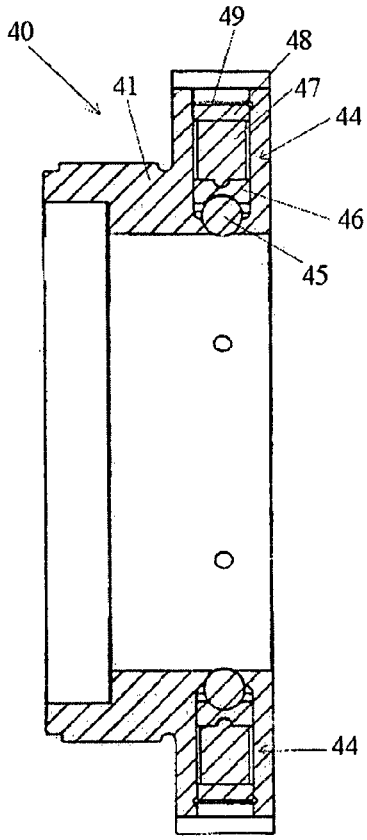
FIG. 29 is a sectional view of the clamp ring retainer assembly of FIG. 28 taken along line 29-29.
Figure 30:
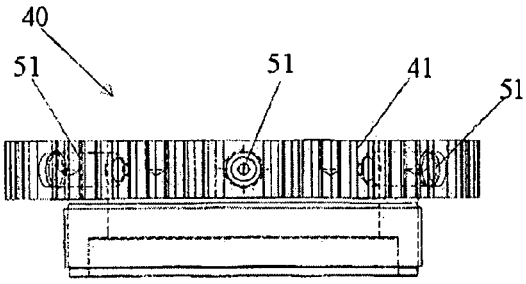
FIG. 30 is a top view of the clamp ring retainer assembly of FIG. 28.
Figure 31:
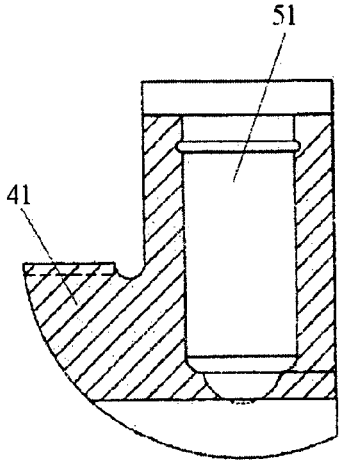
FIG. 31 is an exploded view of the biasing means cavity of the clam ring retainer assembly of FIG. 30.

Important in this invention is the floating clamp ring 43 provided by the clamp ring retaining assembly 40 having the radially disposed biasing means 44, as particularly shown in FIGS. 28-31. Six biasing structures 44 are shown in FIG. 28 equally spaced and radially extending to contact and float the clamp ring 43. As shown in FIG. 31, each cavity 51 is formed to receive the ball member 45, first cap member 46, compressible spring member 47, second cap member 48 and clip member 49. FIGS. 28 and 29 particularly show the spherical ball members 45, cooperating and formed first cap member 46, compressible and cooperating compressible spring member 47 having a centrally disposed protrusion, second cap member 48 and clip member 49. Clip member 49 is shown disposed at the top of the biasing means 44 and is constructed to snap into the groove shown at the top of cavity 51 of FIG. 31. This arrangement compresses the spring member 47 to provide a sufficient preload pressure on the ball member 45 to center and control the float of the clamp ring. The ball member preferably slightly extends from clamp ring retainer body 41 for contact with clamp ring 43. This biasing structure 44 comprising the cooperating elements described, i.e., spherical ball members 45 (nitrite) and compressible springs 47 (urethane), provide a peripherally acting biasing means which float the clamp ring 43.

In use, when the bodymaker punch and can body hits the clamp ring, the floating clamp ring is permitted to center itself around the punch. As the punch continues to travel into the bottom forming assembly, the clamp ring will move the punch so that it and the can body are centered with respect to the bottom forming assembly. The can body is then guided to the domer die plug, where the can bottom is set. The punch forces the can body into the front end of the bottom forming assembly which contains a mold of the desired shape for the can bottom, thereby setting the dome on the bottom of a two piece can. Since the punch is centered with respect to the doming assembly, the incidence of producing can deformities, i.e., split domes, is reduced, the intended base profile is kept square and ram whip and its effects are reduced. Ram whip results when the punch has finished its forward stroke but whips around as it returns back through the bodymaker. The whipping action may also cause the withdrawing punch to damage the carbide in the ironing dyes, which are expensive to replace. It is therefore prudent and beneficial to provide improved means to center the punch or ram member.

In summary, the present invention provides an improved bottom forming assembly that include a novel arrangement of bottom former components, a compact and lightweight construction and a biasing means to float the clamp ring. By arranging the components in the manner shown and described herein and constructing some of the components of aluminum instead of tool steel, the center of gravity of the bottom former assembly is moved closer to the mounting apparatus on the bodymaker, thereby preventing the bottom forming assembly from sagging and becoming out of alignment with the bodymaker punch. By providing biasing means to float the clamp ring and thereby guide the bodymaker punch, the bottom former performance is further improved. Further, by arranging the components as described herein, a compact assembly is provided with an increased piston size and an increased annular spring surface to allow for a greater clamp ring pressure to manufacture desired can bottom profiles.

As many changes are possible to the embodiments of the assemblies of this invention utilizing the teachings thereof, the descriptions above, and the accompanying drawings should be interpreted in the illustrative and not in the limited sense.

That which is claimed is:

1. A can bottom forming assembly for forming the bottom of a can body and for attachment to a body maker having a punch, said bottom forming assembly comprising:

a) a housing assembly having an outer housing, a cylinder housing and a cover chamber connected to said cylinder housing, said cylinder housing being constructed and arranged for sliding engagement within said outer housing, said cylinder housing having opposing axially aligned cylinders separated by a circular wall with an annular peripheral ledge extending outward from said axially aligned cylinders;

b) a clamp ring retainer assembly having biasing means to float a clamp ring, wherein said clamp ring retainer assembly is constructed and arranged to be partially positioned within said outer housing;

c) a clamp ring and a domer die plug for contact with the can body;

d) a piston assembly in communication with said domer die plug;

e) an annular compressible spring member constructed and arranged for placement on said cylinder housing to absorb movement of said cylinder housing with respect to said outer housing; and f) means to attach the can bottom forming assembly to a bodymaker assembly, said means to attach including a mounting flange, at least one tension bolt and at least one spacer member and wherein a spring plate is spaced from said peripheral ledge and wherein said tension bolt extends through said spring plate, said annular spring member, said spacer and said outer housing.

2. The can bottom forming assembly of claim 1, wherein said biasing means of said clamp ring retainer assembly comprises a plurality of biasing members, each comprising a compressible spring member and a cooperating rigid ball member, each said ball member having a generally spherical shape.

3. The can bottom forming assembly of claim 1, wherein an annular spring member is mounted against said annular ledge and around one said cylinder.

4. The can bottom forming assembly of claim 2, wherein said spring member of said biasing means is constructed of urethane and said ball member is constructed of nitrite.

5. The can bottom forming assembly of claim 1, further having a polymeric composite bushing and wherein said cylinder housing moves within said outer housing via said bushing.

6. The can bottom forming assembly of claim 1, further having a ceramic bushing and wherein said piston assembly moves within said cylinder housing via said ceramic bushing.

7. The can bottom forming assembly of claim 1, wherein said cover chamber includes an aperture for receiving a pressurized air line.

8. The can bottom forming assembly of claim 1, wherein said annular spring member is constructed of urethane.

9. The can bottom forming assembly of claim 1, wherein said cover chamber is constructed of aluminum and wherein said outer housing, clamp ring retainer assembly, cylinder housing and said piston assembly are constructed of tool steel.

10. The can bottom forming assembly of claim 1, wherein said assembly further comprises a locking means constructed and arranged to secure said clamp ring retainer assembly.

11. A can bottom forming assembly for attachment to a bodymaker having a punch, said bottom forming assembly comprising:

a) a housing assembly having a floating clamp ring to center the movement of the punch;

b) a clamp ring retainer assembly having a plurality of formed cavities, said clamp ring retainer surrounding said floating clamp ring and said cavities having an opening facing said clamp ring, said clamp ring retainer assembly being constructed and arranged to be partially positioned within said outer housing;

c) biasing means positioned in each said formed cavity for centering said floating clamp ring assembly, said biasing means comprising a ball pin structure and a cooperating compressible member;

d) said housing assembly including an outer housing, a cylinder housing and a cover chamber connected to said cylinder housing, said cylinder housing comprising opposing axially aligned cylinders separated by a circular wall having an annular peripheral ledge extending outward from said axially aligned cylinders; and e) a domer die plug for contact with the can body, a piston assembly, an annular spring member mounted against said annular peripheral ledge and around one said cylinder of said cylinder housing. and means to attach the can bottom forming assembly to a bodymaker assembly, said piston assembly being positioned for sliding engagement within said cylinder housing and said clamp ring being in communication with said piston assembly.

12. The can bottom forming assembly of claim 11, wherein said ball pin member has a generally spherical shape and is constructed of nitrite and wherein said cooperating compressible member is constructed of a urethane composition.

13. The can bottom forming assembly of claim 11, wherein said annular spring member is constructed of urethane, wherein said cover chamber is constructed of aluminum and wherein said outer housing, clamp ring retainer assembly, said cylinder housing and said piston assembly are constructed of tool steel.

14. The can bottom forming assembly of claim 11, wherein said can bottom forming assembly further comprises a plurality of push rods connecting said piston assembly and said clamp ring, said push rods extending through one said cylinder of said cylinder housing and wherein each said push rod has an elongated body having a diameter and an end portion having a diameter larger than the diameter of said body.

15. A can bottom forming assembly for forming the bottom of a can body and for attachment to a bodymaker having a punch, said bottom forming assembly comprising:

a) a housing assembly having an outer housing, a cylinder housing and a cover chamber connected thereto, said cover chamber defining a pressure relief chamber, said cylinder housing comprising opposing axially aligned cylinders separated by a circular wall having an annular peripheral ledge extending outward from said axially aligned cylinders;

b) a clamp ring and a domer die plug for contact with the can body;

c) a clamp ring retainer assembly having biasing means to float said clamp ring, wherein said clamp ring retainer assembly is constructed and arranged to be partially positioned within said outer housing and wherein said means to float said clamp ring comprises a ball pin member having a generally spherical shape and a cooperating compressible member, said ball pin member being constructed of nitrite and said cooperating compressible member being constructed of urethane;

d) a piston assembly having at least one push rod extending between said piston assembly and said clamp ring;

e) an annular spring member mounted against said annular ledge and around one said cylinder;

f) means to attach the can bottom forming assembly to a bodymaker assembly; and g) a polymeric composite bushing and a ceramic bushing, wherein said piston assembly moves within said cylinder housing via said ceramic bushing, and wherein said cylinder housing moves with said outer housing via said composite bushing.

16. The can bottom forming assembly of claim 15, wherein said annular spring member is constructed of urethane, wherein said cover chamber is constructed of aluminum and wherein said outer housing, clamp ring retainer assembly, said cylinder housing and said piston assembly are constructed of tool steel.

17. The can bottom forming assembly of claim 1, further comprising a plurality of push rods connecting said piston assembly and said clamp ring, said push rods extending through one said cylinder of said cylinder housing and wherein each said push rod has an elongated body having a diameter and an end portion having a diameter larger than the diameter of said body.

18. The can bottom forming assembly of claim 11, further having a polymeric composite bushing and wherein said cylinder housing moves within said outer housing via said bushing.

19. The can bottom forming assembly of claim 11, further having a ceramic bushing and wherein said piston assembly moves within said cylinder housing via said ceramic bushing.

20. The can bottom forming assembly of claim 15, wherein said cover chamber includes an aperture for receiving a pressurized air line.

* * * * *